United States Patent [19]

Grass

[11] Patent Number: 4,620,343

[45] Date of Patent: Nov. 4, 1986

[54] THREE WAY ADJUSTABLE DOOR HINGE HAVING COOPERATING WEDGE SURFACES

[76] Inventor: Alfred Grass, Konsumstrasse 20, A-6973 Höchst, Austria

[21] Appl. No.: 534,595

[22] Filed: Sep. 23, 1983

[30] Foreign Application Priority Data

Sep. 24, 1982 [DE] Fed. Rep. of Germany ..... 3235402

[51] Int. Cl.[4] ..... E05D 7/04

[52] U.S. Cl. ..... 16/236; 16/240; 16/246; 16/370; 16/382

[58] Field of Search ..... 16/236, 237, 238, 245, 16/246, 370, 382

[56] References Cited

U.S. PATENT DOCUMENTS 3,913,173 10/1975 Rock et al. ..... 16/237
4,313,239 2/1982 Tsuneki ..... 16/236
4,359,802 11/1982 Rock ..... 16/238

FOREIGN PATENT DOCUMENTS 2513089 9/1975 Fed. Rep. of Germany ..... 16/246
2528328 7/1976 Fed. Rep. of Germany ..... 16/382
2733831 3/1978 Fed. Rep. of Germany ..... 16/382
2802463 5/1979 Fed. Rep. of Germany ..16/DIG. 43

*Primary Examiner*—Fred Silverberg
*Attorney, Agent, or Firm*—Parmelee, Miller, Welsh & Kratz

[57] ABSTRACT

There is described a door hinge which is adjustable by way of three screws in height, in the lengthwise direction and in inclination, wherein wedge surfaces are formed between an adjusting plate and an intermediate plate which prevent an unintentional sliding displacement of the structural parts relative to one another, even when the height adjusting screw is drawn up tight.

1 Claim, 7 Drawing Figures

THREE WAY ADJUSTABLE DOOR HINGE HAVING COOPERATING WEDGE SURFACES

This invention relates to a door hinge with a spring loaded hinge arm with a base plate with fastening holes, over which there is an adjusting plate, and over the latter, further, an intermediate plate, wherein an inclination adjustment screw that is actuatable from outside and is supported with its head on the hinge arm is screwed through a hole in the hinge arm into a threaded hole in the adjusting or intermediate plate; further, a length adjustment screw that is likewise actuatable from outside grips through a slot in the intermediate plate, is screwed into a threaded hole in the adjusting plate and is supported with its tip on the base plate, and there is also provided a height adjustment screw that is actuatable from outside which grips through a hole in the intermediate plate and is screwed into a threaded hole in the adjusting plate, and wherein, further, a pivot bearing is formed between the hinge arm and the intermediate plate on the end of the adjusting plate that is remote from the tilting adjustment screw.

Such a door hinge is known for example from West German published patent application Nos. 2,733,831 and 2,528,328. It is common to both of the known embodiments that the height adjustment screw attains only an insufficient force fixing the intermediate plate to the adjusting plate. There, in particular, the intermediate plate is guided by means of a ridged groove guide to be slidable and securable in the heightwise direction on the adjusting plate. Upon drawing up the height adjustment screw, certainly only the middle region of the intermediate plate is secured in relation to the adjusting plate, so that after long continued force loading and after being acted upon by turning moments the intermediate plate could inadvertently loosen and slide relative to the adjusting plate.

The invention avoids this disadvantage. It has as its objective to so configure a door hinge having the characteristics set forth in the introduction that while retaining the advantages of the known door hinges, high forces can also be taken up without there being a possibility of an inadvertent sliding between the intermediate plate and the adjusting plate when the height adjusting screw is pulled up tight.

To solve this problem, the invention is characterized in that the intermediate plate has wedge surfaces on both of its ends that lie against correspondingly inclined opposing wedge surfaces of the adjusting plate, wherein the inclinations of the wedge surfaces define an acute angle with the axis of the height adjusting screw and, in common, extend in the direction toward the swinging axis of the hinge or in the opposite direction.

What is achieved with these two opposingly directed wedge surfaces on the ends adjacent to the door and remote from the door, between the intermediate plate and the adjusting plate, is that upon pulling up the height adjusting screw the intermediate plate undergoes a short sliding movement and tensioning movement along the wedge surfaces in relation to the adjusting plate, so that an absolutely secure and force locking tensioning is imposed on these wedge surfaces. Wedge surfaces thus tension themselves against one another so that substantially higher loads can now be carried.

It is preferred that all wedge surfaces be inclined in the direction toward the swinging axis of the hinge. However, it is also possible for all wedge surfaces, and thus also all opposing wedge surfaces, to be aligned in the opposite direction thereto.

The wedge surfaces and opposing wedge surfaces can also have corrugations or the like whereby the gripping effect between these surfaces is further improved.

The invention is more particularly explained in the following with reference to an exemplary embodiment from which further important features will appear.

Figure 1:
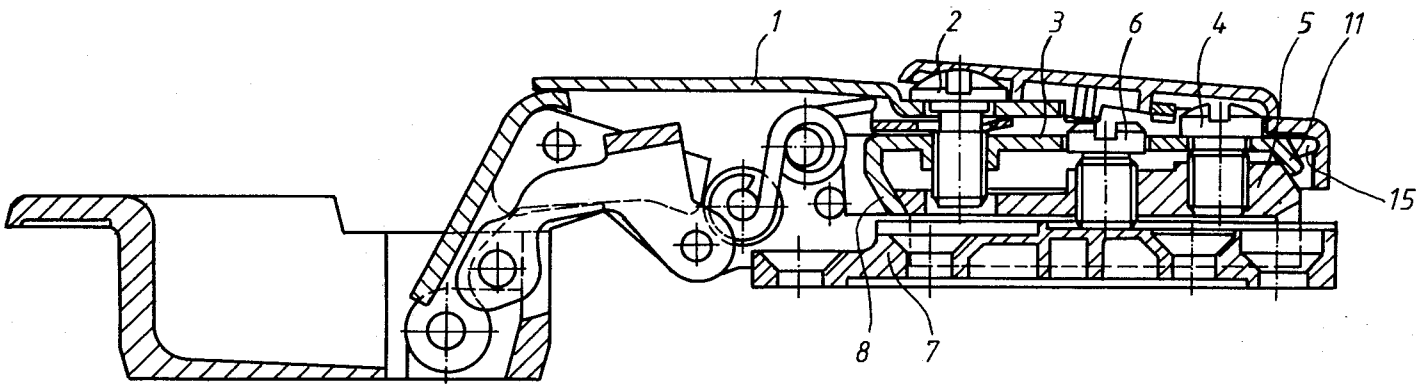
FIG. 1 is a longitudinal section through a novel door hinge.

According to FIG. 1, the hinge comprises a hinge arm 1 that is connected with an intermediate plate 3 with the help of an inclination adjusting screw 2. The intermediate plate 3 is connected with an adjusting plate 5 by means of a height adjusting screw 4. The adjusting plate 5 is connected by means of a length screw 6 with a base plate 7 that is screwed to the securement surface. The hinge arm 1 is thus adjustable in three different directions in relation to the base plate 7, namely, adjustable as to inclination, adjustable as to height and lengthwise adjustable.

According to the invention, the intermediate plate 3 has at its end adjacent to the door a bent out shank 8 that defines on its inner side a wedge surface 9 that engages under a similar opposing wedge surface 10 on the adjusting plate 5.

On the end remote from the door the intermediate plate 3 likewise has a bent out shank 11 that forms an interior wedge surface 12, with which a similar type of opposing wedge surface 13 on the front side of the adjusting plate cooperates.

In another embodiment the wedge surfaces of the ends near and remote from the door can also be interchanged with one another, that is, the wedge surfaces 12, 13 that are now on the end remote from the door can be arranged on the end adjacent to the door, and, reversely, the wedge surfaces 9, 10 that are now disposed on the end adjacent to the door can be on the end remote from the door. Also, all of the wedge surfaces, instead of being inclined to the left of the swinging axis of the hinge as in FIG. 1, can be inclined to the right.

Likewise, corrugations and other friction increasing coverings can be provided in the region of the wedge surfaces, in order to further improve the force locking.

Figure 2:
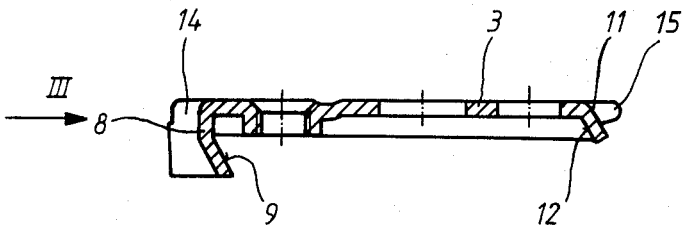
FIG. 2 is a longitudinal section through an intermediate plate of this door hinge.
Figure 3:
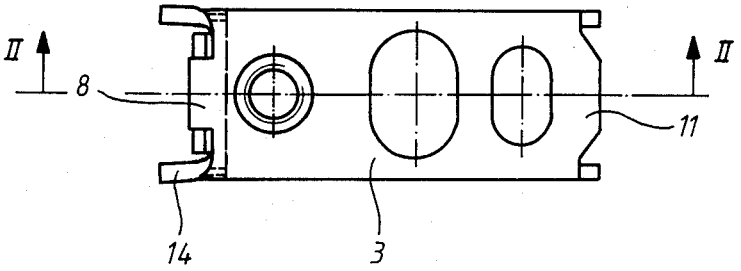
FIG. 3 is a plan view of the intermediate plate.

FIG. 2 shows the intermediate plate in section according to line II—II in FIG. 3, while FIG. 3 shows the plan view of the intermediate plate. It is apparent that the tongue 8 comprises a bent out portion, that is, the entire intermediate plate comprises a stamped blank that is suitably trimmed and bent. In this the tongue is bent out of the material of the intermediate plate, whereby lateral shanks 14 are left standing. The wedge surface 9 is disposed on the lower and inner side of the tongue. On the front side a similar type of shank 11 is bent out, on the underside of which the wedge surface 12 is disposed.

Figure 4:
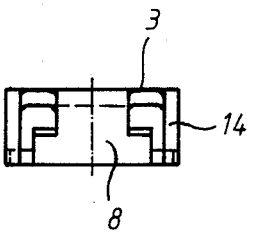
FIG. 4 is a front view of the intermediate plate.

FIG. 4 shows the front view of the intermediate plate in the direction of the arrow III in FIG. 2, wherein it is apparent that the lateral arms 14 have remained standing and the shank 8 is bent out and engages under the shanks 14 with lateral lugs so that an absolutely secure connection between the shank 8 and the lateral shanks 14 is formed, so that the shank 8 can no longer be unintentionally bent upward.

Figure 5:
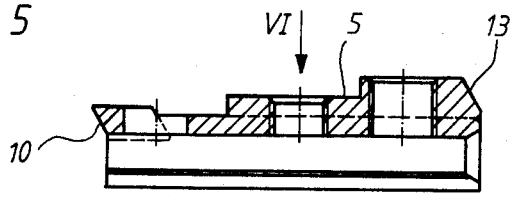
FIG. 5 is a longitudinal section through the adjusting plate.
Figure 6:
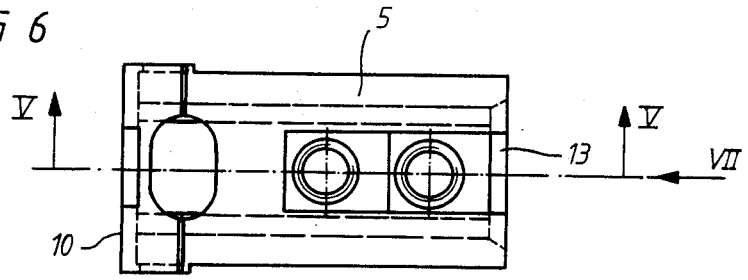
FIG. 6 is a plan view of the adjusting plate.
Figure 7:
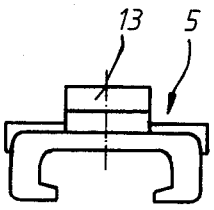
FIG. 7 is a front view of the adjusting plate.

FIG. 5 shows a section through the adjusting plate in the direction of the arrow V—V in FIG. 6, while FIG. 6 is a plan view of the adjusting plate in the direction of the arrow VI in FIG. 5, and FIG. 7 is a front view of the adjusting plate in the direction of the arrow VII in FIG. 6. The adjusting plate 5 comprises in this case a zinc die cast part upon the front of which, at the end adjacent the door, the wedge surface 10 is disposed, while the wedge surface 13 is arranged on the end remote from the door. In FIG. 7 the wedge surface 13 is visible in front elevation.

It is important that the intermediate plate still forms with the hinge arm a pivot bearing 15 on the end remote from the door, and thus, with this intermediate plate, two different functions are performed.

With reference to FIGS. 1, 2, and 5, it will be noted that there is a dual wedging engagement between opposite ends of the adjusting plate 5 and the intermediate plate 3 as represented by wedge surfaces 10 and 13 of the adjusting plate 5 and cooperating wedge surfaces 9 and 12 of the intermediate plate 3.

As shown in FIGS. 1, 6, and 7, the base or underside of the adjusting plate 5 is of lengthwise extending channel shape, and thus serves as a retaining means for longitudinal guided movement of the base plate 7 therealong. Position retention of the base plate 7 is, as shown in FIG. 1, accomplished by screw-down engagement of the adjusting screw 6 with an upper face portion of the thus endwise-slidable base plate 7. FIG. 1 also shows typical mounting holes to securely mount a base plate, such as 7, on door frame or the like.

What is claimed as the invention is:

1. A door hinge of the type comprising an elongated base plate for fixedly being secured to a door frame and having a rear surface which is adapted to be in a door frame plane, an elongated hinge arm lengthwise overlying the base plate in front of the same and having one end portion which is spaced lengthwise beyond the base plate and to which a door supporting element is connected for swinging about an axis that is transverse to the length of the hinge arm and parallel to said plane, an elongated intermediate plate confined between the hinge arm and the base plate and to which the hinge arm is connected for relative swinging through a range of positions of inclination adjustment that carry its said end portion towards and from said plane and for securement in any selected one of those positions, and an elongated adjusting plate confined between the intermediate plate and the base plate, to which the intermediate plate has a heightwise adjustable connection and which is connected with the base plate for lengthwise sliding relative thereto through a range of positions of lengthwise adjustment and for securement in any selected one of those positions, said door hinge being characterized by:

said heightwise adjustable connection between the intermediate plate and the adjusting plate comprising (1) a screw having (a) a head overlying the front face of the intermediate plate and (b) a shank extending through a slot in the intermediate plate that is intermediate its ends and is elongated transversely to its length, said shank having a threaded portion which is received in a matingly threaded hole in the adjusting plate, intermediate the ends thereof, so that tightening of said screw draws the intermediate plate flatwise rearward towards the adjusting plate;

(2) means on each end of the intermediate plate defining a wedge surface which extends widthwise relative to the intermediate plate and is inclined obliquely rearward at an acute angle to the axis of said screw, both of said wedge surfaces being inclined in the same direction, and (3) means on each end of the adjusting plate defining a cooperating complementary shaped wedge surface for each of said wedge surfaces on the intermediate plate, each of said cooperating wedge surfaces being flatwise opposingly engaged by its wedge surface on the intermediate plate so that the weight of a door on said door supporting element, tending to rotate the intermediate plate about said screw and relative to the adjusting plate, and causing the cooperating wedge surfaces to wedgingly engage each other.

* * * * *